US005873313A

United States Patent [19]

Minami et al.

[11] Patent Number: 5,873,313

[45] Date of Patent: Feb. 23, 1999

[54] MAGNETIC SEPARATOR AND PULVERIZED COAL COMBUSTION APPARATUS USING THE SAME

[75] Inventors: Masaharu Minami; Hiroyuki Katayama, both of Takasago; Takuya Kimura, Kobe, all of Japan

[73] Assignee: Mitsubishi Heavy Industries, Ltd., Tokyo, Japan

[21] Appl. No.: 845,348

[22] Filed: Apr. 25, 1997

[51] Int. Cl.[6] ..... F23D 1/00

[52] U.S. Cl. ..... 110/220; 110/263; 209/213; 209/215; 209/231

[58] Field of Search ..... 110/220, 222, 110/232, 263, 292; 209/214, 215, 213, 224, 225, 231

[56] References Cited

U.S. PATENT DOCUMENTS

| | | | |
|---|---|---|---|
| 4,239,619 | 12/1980 | Aplan et al. | 209/214 |
| 4,340,468 | 7/1982 | Hise, Jr. et al. | 209/214 |
| 4,438,709 | 3/1984 | Borio et al. | 110/263 X |
| 4,478,711 | 10/1984 | Cohen et al. | 209/214 X |
| 4,608,155 | 8/1986 | Desportes et al. | 209/224 |
| 4,778,594 | 10/1988 | Doctor et al. . | |
| 4,961,841 | 10/1990 | Andres et al. | 209/214 X |

*Primary Examiner*—Henry A. Bennett
*Assistant Examiner*—Susanne C. Tinker
*Attorney, Agent, or Firm*—Bell Seltzer Intellectual Property Law Group of Alston & Bird LLP

[57] ABSTRACT

In a vacuum housing (1), an inner duct (17) is disposed. Quadrupole magnets (superconducting coils) (4) is placed around the inner duct (17) is excited by a DC power supply (10). Quadrupole magnets (4) are cooled by liquid helium contained in a helium housing and outer tubes (2, 3) and is brought into a superconducting state. Pulverized coal X is ejected together with air Y from a header (11) through piping (12) and a valve (13) to a baffle plate (14). Pulverized coal is made to fall into the inner duct (3). Paramagnetic materials such as ash are attracted by magnetic force to the tube and are then collected by a collection tube (26). Combustible diamagnetic materials are collected by a combustible collecting tube (18) extending in the central axis. Intermediate materials are collected by an intermediate collection tube (23) and are put back to the head (11) through a bypass tube (25). There are no mechanical parts in the inner duct (3). Consequently, rotation loss and eddy-current heating are prevented.

7 Claims, 9 Drawing Sheets

MAGNETIC SEPARATOR AND PULVERIZED COAL COMBUSTION APPARATUS USING THE SAME

BACKGROUND OF THE INVENTION

1. Field of the Invention

The present invention relates to a magnetic separator (namely, a magnetic separation apparatus) used for coal cleaning and to a pulverized coal combustion (or firing or burning) apparatus using the magnetic separation apparatus (or system).

2. Description of the Related Art

FIG. 9 is a diagram illustrating the principle of magnetic separation, which shows the distribution of lines of magnetic force of quadrupole magnets and the magnetic field strength distribution in an inner duct thereof. In this figure, reference numeral 40 designates quadrupole magnets that have a quadrupole structure provided in a circle therein. The lines 41 of magnetic force are generated by this magnet 40. Here, let (dH/dZ), H, X and V denote magnetic field gradient, magnetic field strength, magnetic susceptibility and the volume of a fine particle, respectively. Magnetic force Fm given by the following equation (1) acts in the direction of the magnetic field gradient:

$$Fm=\chi\mu_o VH(dH/dZ) \quad \ldots (1)$$

Incidentally, in the aforementioned equation (1), $\mu_o$ denotes an absolute permeamibility of vacuum. Magnetic separation is performed by utilizing a variation in this magnetic force, which is caused due to a change in the magnetic susceptibility of this fine particle. As illustrated in FIG. 9, the magnetic force Fm given by the aforementioned equation (1) acts upon a fine particle contained in the inner duct 42 of the four-pole magnet 40. Variation in this magnetic force results in a change in the position in the Z-direction of each fine particle, so that the magnetic separation is achieved.

FIG. 10 is a diagram conceptually illustrating a section of a conventional magnetic separator employing such a principle of magnetic separation and illustrates an apparatus 110 for separating a dry paramagnetic material from a dry diamagnetic fine-grain material. Hereinafter, this apparatus will be described in detail.

A wall 114 and an inner space 116 vertically extend in the axial direction of the apparatus and thus compose a cylinder 112. Rotary screw 118 is installed in the cylinder 112. The screw 118 consists of the shaft 120 and a helical blade 122. The helical blade 122 is angled downwardly in both of the radial and axial directions and is accommodated inside the wall 114. The screw 118 is connected to a motor 124 and is rotated by this motor 124, so that fine particles are carried from the top portion of the screw 118 downwardly. A vibration drive or exciter (namely, a shaker) 126 is connected to the screw 118. The screw 118 is shaken during the rotation thereof.

A magnet 128 is disposed around the wall of the cylinder 112. This magnet 128 acts the magnetic field in the inner space 116. Thus, there is constructed a four-pole magnet, by which the magnetic field gradient is given in the inner space 116. The magnetic field (strength) has a maximum value on the wall 114. Further, the magnetic field strength at a point decreases as the point approaches the shaft 120. This magnetic field is constant in a central zone 129. In an edge portion 132, the magnetic field decreases linearly in the upward direction from an edge 132 of the magnet 128.

To enhance the separation ability or performance, a pulverizer 134 is used. Pulverized coal is sent by an auger 136 to a movable coal feeder 138. Then, the pulverized coal is sent from the coal feeder 138 to the helical blade 122. Rotation of the screw 18 brings the pulverized coal into the apparatus 110.

Paramagnetic fine particles of kaolinite and ash undergo the magnetic force Fm illustrated in FIG. 9 and move toward the wall 14, while fine particles of combustible (organic) content contained in the coal, which are diamagnetic fine particles, move along the direction of the shaft 120.

A splitter 142 is provided in a lower portion of the apparatus 110 and is composed of three concentric cylinders or tubes 144, 146 and 148. The tube 144 collects fine particles (incidentally, major constituents thereof are diamagnetic fine particles), which approaches the shaft 120. The tube 148 collects fine particles (incidentally, major constituents thereof are paramagnetic fine particles), which approaches the wall 114. The tube 146 collects a mixture of antimagnetic and paramagnetic fine particles.

The aforementioned conventional magnetic separator 110 has the following problems:

(1) Mechanical drive parts such as the screw 118, the rotary shaft 120, the motor 124, the vibration exciter 126 and the helical blade 122 are provided in the inner duct of the quadrupole magnet, so that the clogging thereof owing to the fine particles and the abrasion thereof occur.

(2) Residual magnetization occurs in machine parts with the result that the fine particles adhere to the blade and so forth. Consequently, the separation performance is degraded.

(3) Leakage current occurring in the rotating parts results in the generation of heat and in the occurrence of rotation loss.

(4) When using a superconducting magnet in the case that electric current is directly supplied to the quadrupole magnets from the power supply, losses occur in an electric lead and in a normal conducting part of the power supply. Further, in the case of using the normal conducting magnet, losses are produced in the entire system.

(5) In the case that the aforementioned conventional magnetic separator 110 is applied top as an apparatus of separating combustible (organic) materials from incombustible materials (such as pearlite, kaolinite and ash), if this magnetic separator is provided separately from a combustion apparatus, there is the necessity of labor and space for the storage, retention and conveyance of separated materials. Consequently, the cost of the magnetic separator is increased.

OBJECT AND SUMMARY OF THE INVENTION

Accordingly, an object of the present invention is to provide means for solving the aforementioned problems of the conventional apparatus.

A practical object of the present invention is to prevent occurrences of rotation losses and eddy currents in a magnetic separator used for coal cleaning and in a pulverized coal combustion apparatus, which uses the magnetic separator, by eliminating the mechanical parts and using a superconducting coil.

Another object of the present invention is to provide a compact high-quality high-efficiency pulverized coal combustion apparatus (or system), by which the labor and space to be taken to achieve the storage, retention and conveyance of combustible (organic) materials that are separated and collected for coal leaning.

To achieve the foregoing objects, in accordance with the present invention, there is provided the following means.

(1) Namely, there is provided a magnetic separator (hereunder sometimes referred to as a first magnetic separator of the present invention) which comprises a cylindrical inner duct disposed along the vertical direction; quadrupole magnets constituted by superconducting coils, which are placed around the aforesaid inner duct and are cooled by liquid helium and are excited by use of a DC power supply; fine-particle supply means for ejecting and dropping fine particles, which consist of a plurality of elements and compounds, from a top end of the aforesaid inner duct; and first and second collection tubes, which are provided at a bottom portion of the aforesaid inner duct, for separating and collecting a paramagnetic material and a non-magnetic material, which are included in the aforementioned fine particles, owing to a difference between magnetic forces respectively acted on the aforementioned fine particles, which are ejected from the aforementioned fine particle supply means and drop.

(2) Further, in the case of an embodiment (hereunder sometimes referred to as a second magnetic separator of the present invention) of the magnetic separator described in the aforesaid first magnetic separator of the present invention, the aforesaid fine-particle supply means comprises an umbrella-like baffle plate disposed in the aforesaid top end portion, wherein fine particles are ejected upwardly toward the aforesaid baffle plate from a lower portion thereof, and then the fine particles having collided with the aforesaid baffle plate are caused to drop toward the aforesaid inner duct.

(3) Further, in the case of an embodiment (hereunder sometimes referred to as a third magnetic separator of the present invention) of the magnetic separator described in the aforesaid first or second magnetic separator of the present invention), the aforesaid quadrupole magnets comprise normal conducting coils and are cooled with liquid helium.

(4) Further, in the case of an embodiment (hereunder sometimes referred to as a fourth magnetic separator of the present invention) of the magnetic separator described in the aforesaid first or third magnetic separator of the present invention), a persistent current circuit switch is connected in parallel with the aforesaid quadrupole magnets.

(5) Further, in the case of an embodiment (hereunder sometimes referred to as a fifth magnetic separator of the present invention) of the magnetic separator described in the aforesaid first or second magnetic separator of the present invention), an intermediate-material collection tube, which is operative to collect intermediate materials, and a bypass collection tube, which is operative to supply the material collected by the aforesaid intermediate- material collection tube, are provided between the aforesaid first and second collection tubes.

(6) Furthermore, there is provided a pulverized coal combustion apparatus (hereunder sometimes referred to as a sixth apparatus of the present invention) that comprises:

a magnetic separator having a cylindrical inner duct; quadrupole magnets constituted by superconducting coils, which are placed around the aforesaid inner duct and are cooled by liquid helium and are excited by use of a DC power supply; fine-particle supply means for ejecting and dropping fine particles from a top end of the aforesaid inner duct; and first and second collection tubes, which are provided at a bottom portion of the aforesaid inner duct, for separating and collecting a paramagnetic material and a non-magnetic material, which are included in the aforementioned fine particles ejected from the aforementioned fine particle supply means and drop;

a pulverized coal manufacturing unit, which is connected to the aforesaid fine-particle supply means, for manufacturing pulverized coal; and a pulverized coal burner connected to the aforesaid second collection tube of the aforesaid magnetic burner.

The present invention achieves the objects by such means. In the case of the first magnetic separator of the present invention, fine particles, which are ejected from the upper part of the inner duct by use of the aforesaid fine-particle supply means, fall under their own weight. Further, paramagnetic materials contained in fine particles are attracted by the force of attraction of the quadrupole magnets to the tube while dropping. Then, the paramagnetic materials are collected from the first collection tube placed at the lower portion of the inner duct. Moreover, non-magnetic materials fall on or along the central axis of the inner duct without being attracted by the second collection tube, and are then collected by the second collection tube. In the case of the second magnetic separator of the present invention, the fine-particle supply means is constituted by the umbrella-like baffle plate, so that after colliding with this baffle plate, the fine particles can be diffused, and can be further scattered uniformly, and can fall under their own weight. Therefore, in this case, the accuracy of the magnetic separation can be enhanced, in addition to the case of the first magnetic separator of the present invention. Moreover, in the case of the fifth magnetic separator of the present invention, the intermediate-material collection tube and the bypass tube are added thereto. Thus, the intermediate material are ejected from the inner duct again. Consequently, in addition to the advantages of the first and second magnetic separators, the fifth magnetic separator of the present invention has the advantage in that the accuracy of the magnetic separation is enhanced.

Thus, in the case of the first, second and fifth magnetic separators of the present invention, there are no rotation drive mechanical parts in a working or operating space. Therefore, troubles due to the mechanical parts in the operating space, such as the clogging, which is owing to the fine particles, and the abrasion, are not caused. Thus, the problem of the residual magnetization, which has been caused in the mechanical parts of the conventional apparatus, does not occur. Moreover, heat emission and rotation loss due to eddy current, which has been generated in the rotating portions of the mechanical parts in the conventional case, are not caused.

Further, in the case of the first magnetic separator, the quadrupole magnets are operated in a persistent current mode, because the superconducting coils are used. Thus, all of the electric circuit is in a superconducting state. Consequently, this prevents an occurrence of power loss due to Joule's heat. Moreover, in the case of the third magnetic separator, the quadrupole magnets are constituted by normal conducting coils. Therefore, for example, when a copper line reaches a liquid nitrogen temperature (−196 degrees centigrade), the resistance of the copper line is reduced by a factor of 5 to 10. Thus, a current passing through the copper line can be increased. Thereby, a high magnetic field can be obtained by the circuit of the same size. Further, a compact apparatus can be realized. The cost of refrigerant can be reduced.

Furthermore, the fourth magnetic separator of the present invention is provided with a persistent current circuit switch, so that a persistent current flows through the quadrupole magnets. There is little necessity of supplying power to the apparatus during an operation thereof. Evaporation of liquid helium is supplemented by heat of penetration (or penetrating heat).

Further, in the sixth apparatus of the present invention, the magnet separator is incorporated into the pulverized coal manufacturing apparatus and combustion facilities. Thus, the magnetic separator separates paramagnetic materials such as ash from non-magnetic materials, which are combustible materials, in pulverized coal and supplies combustible fine particles to a coal combustion burner. Therefore, the labor and space for the storage, retention and conveyance of combustible (organic) materials obtained by the magnetic separation and collection become unnecessary. Consequently, a compact, high-quality high-efficiency coal combustion apparatus (or system) is obtained.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which.

DETAILED DESCRIPTION OF THE PREFERRED EMBODIMENTS

Figure 1:
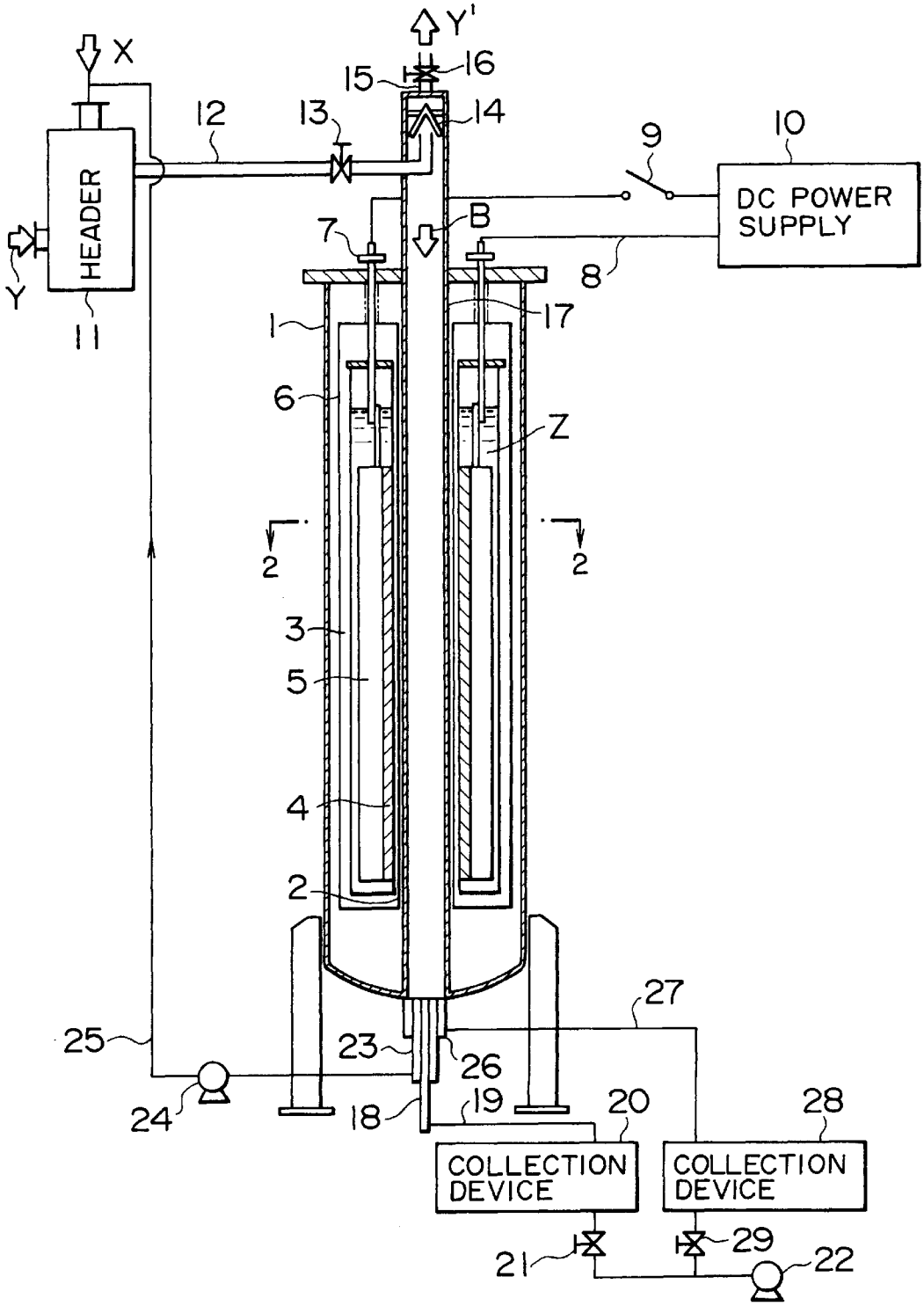
FIG. 1 is a diagram illustrating the configuration of a magnetic separator, which is a first embodiment of the present invention.
Figure 2:
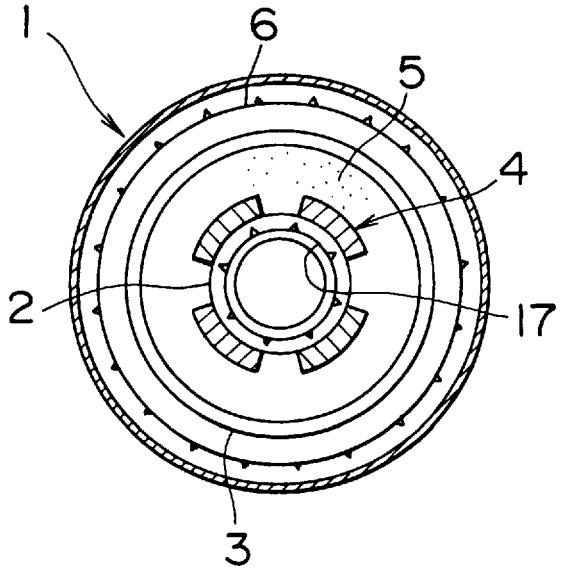
FIG. 2 is a sectional view taken on line A—A of FIG. 1.

Hereinafter, the preferred embodiments of the present invention will be concretely described in detail by referring to the accompanying drawings. FIG. 1 is a sectional view of a magnetic separator which is a first embodiment of the present invention. FIG. 2 is a sectional view taken on line A—A of FIG. 1. In both diagrams, reference numeral 1 designates a vacuum housing; 2 an inner tube or cylinder of a helium housing; 3 an outer tube of the helium housing; 4 quadrupole magnets (superconducting coils); 5 a coil presser; 6 a liquid helium shield (at about 80 K); 7 a current lead; 8 a bus bar; 9 a switch; and 10 a DC power supply. After the coils 4 are cooled with liquid helium Z, the switch 9 is closed, so that electric current is made to pass therethrough. The quadrupole magnets are in an superconducting state. Thus, power loss due to Joule's heat does not occur. During operation, no power is supplied. Evaporation of liquid helium has only to be supplemented by heat of penetration.

Reference numeral 11 is supplied with pulverized coal from X and is fed with air from Y and ejects pulverized coal in solid-gas two-phase state to the umbrella-like baffle plate 14 through the piping 12 and the valve 13. Reference numeral 15 denotes an exhaust duct; and 16 an exhaust valve. Air is exhausted from Y' and pulverized coal is made to fall from B.

Reference numeral 17 designates an inner duct; 18 a combustible-material (diamagnetic) collection tube; 19 collection piping; 20 a collection tube; 21 flow regulating valve; and 22 a blower. Further, reference numeral 23 designates an intermediate collection tube; and 24 a blower. Pulverized coal collected by the intermediate collection tube 23 is put back to the header 11 through a bypass tube 25. Reference numeral 26 denotes a collection tube for collecting ferromagnetic fine particles such pearlite and paramagnetic fine particles such as kaolinite and ash; 27 collection piping; 28 a collection tube; and 29 a flow regulating valve.

Figure 9:
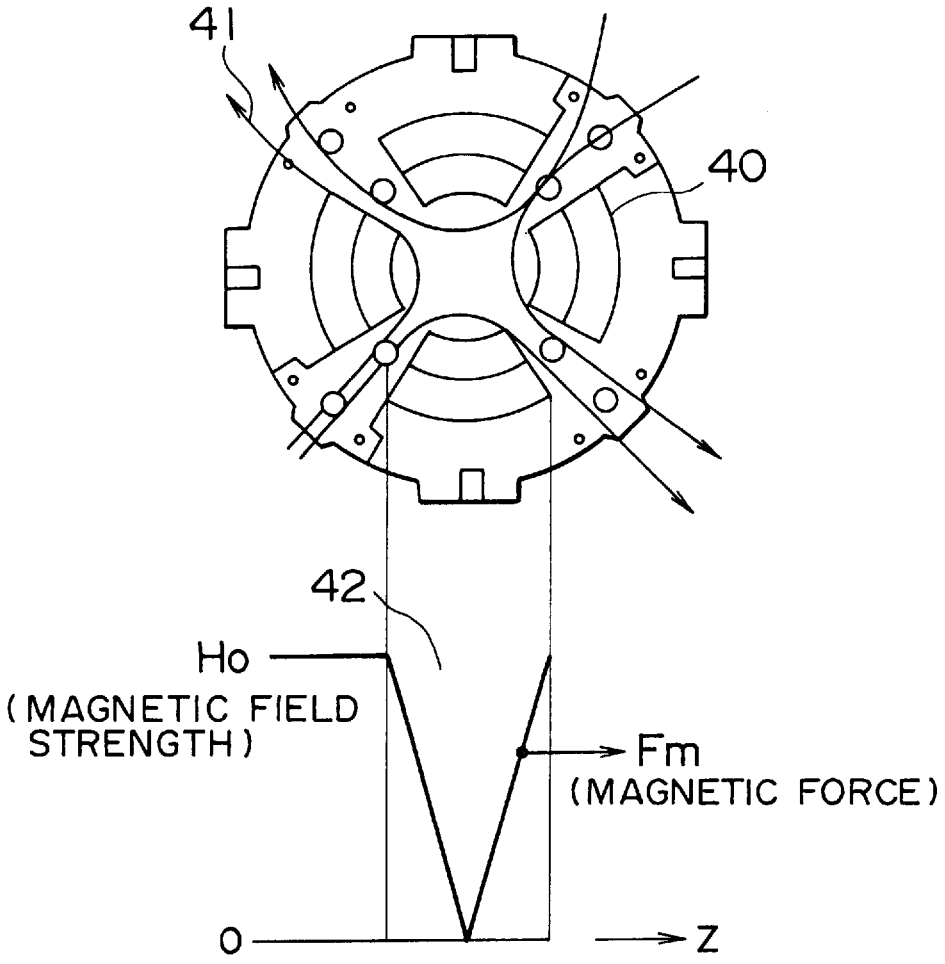
FIG. 9 RELATED ART
FIG. 9 is a diagram illustrating a section of the quadrupole magnets and the principle of magnetic separation.
Figure 10:
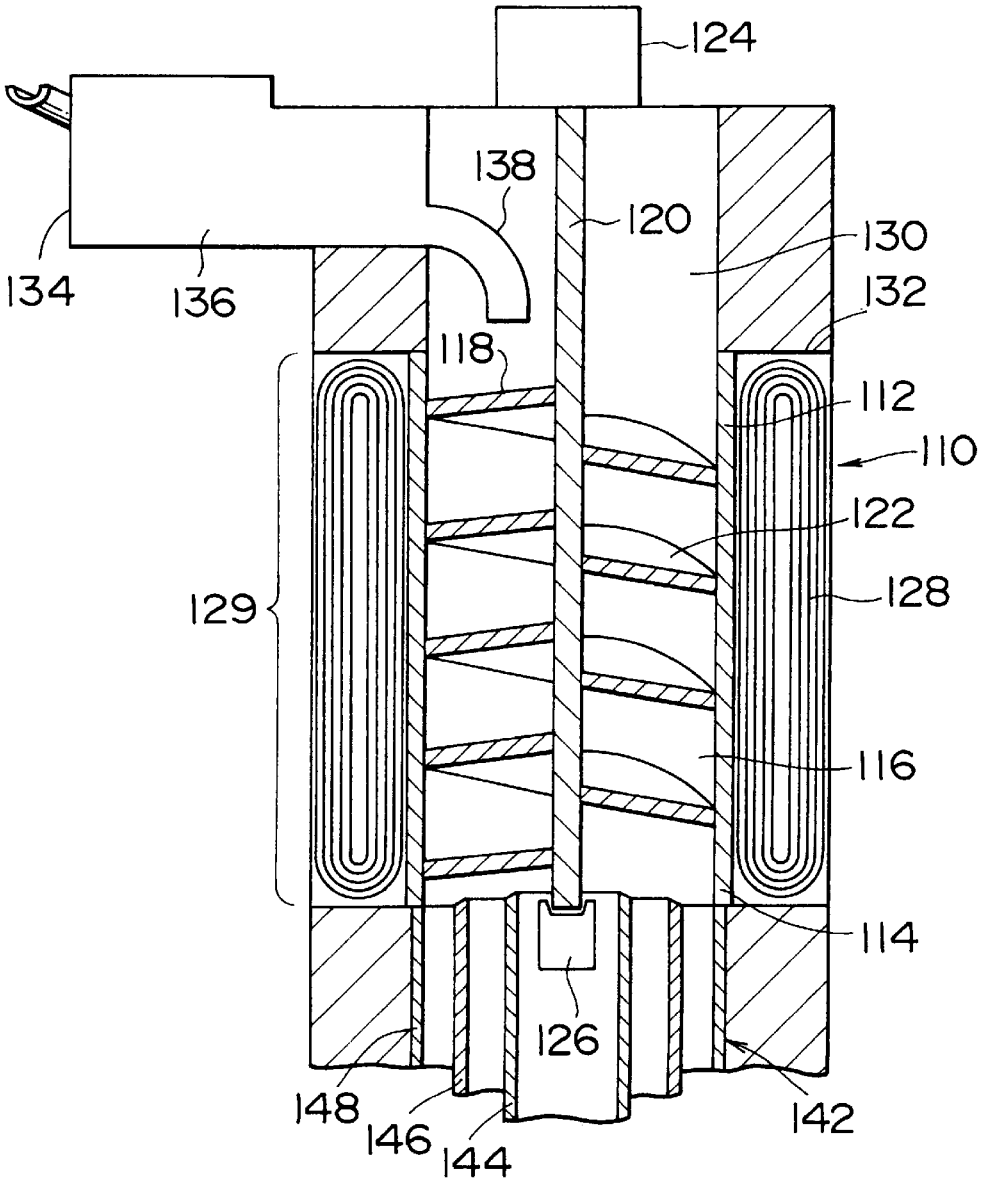
FIG. 10 RELATED ART
FIG. 10 is a sectional view of the conventional magnetic separator.

In such a configuration, the fine particles B fall under their weight from the top end portion of a quadrupole magnets 4 consisting superconducting coils. Further, paramagnetic fine particles, such as kaolinite and ash, undergo magnetic force as illustrated in FIG. 9 and is attracted to the tube or cylinder wall of the inner duct 17, and combustible constituents (organic constituents), which are diamagnetic fine particles, contained in coal are attracted to the central axis of the pulverized , and are collected by the collection tube 26 and the combustible-material collection tube 18, respectively.

Pulverized coal collected by the intermediate collection tube 23 is put back to the header through the bypass tube 25 and is then made to fall under its weight again from the upper part of the inner duct 17. Thus the degree of separation is enhanced.

Figure 6:
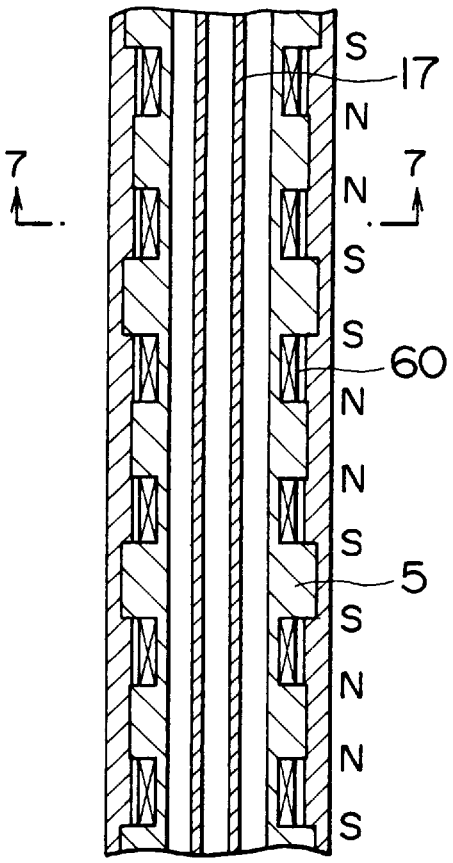
FIG. 6 is a diagram illustrating the configuration of a primary part of a magnet separator using a homopolar opposing solenoid magnet.
Figure 7:
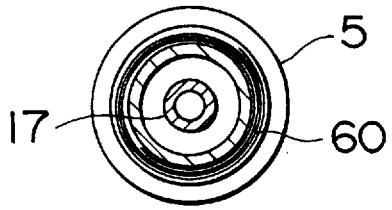
FIG. 7 is a sectional view taken on line B—B of FIG. 6.

Incidentally, when this magnetic separator employs a configuration in which normal conducting coils 60, as illustrated in FIGS. 6 and 7, are used instead of the superconducting coils 4 and further liquid helium is used as the refrigerant so as to obtain a compact separator and reduce the cost of refrigerant, advantages similar to those described hereinabove are obtained.

Figure 8:
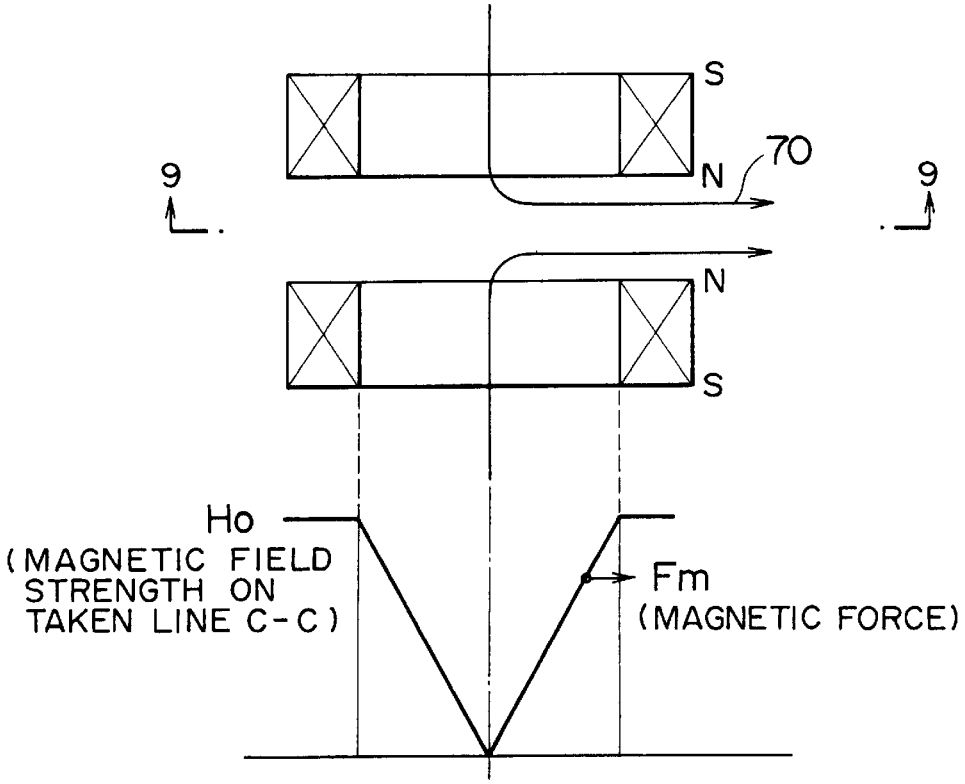
FIG. 8 is a diagram illustrating the distribution of lines of a magnetic force and the magnetic field distribution.

Namely, a plurality of homopolar opposing solenoid magnets 60 as illustrated in FIGS. 6 and 7 may be used instead of the quadrupole magnets 4. In this case, a plurality of solenoid magnets 60 excited in such a manner as to have homopole and are arranged in such a way as to be concentrically along the axis at almost uniform intervals. With such a configuration, the lines of magnetic force 70 are generated as shown in FIG. 8. Thus, the magnetic field distribution as shown in the figure. Therefore, the magnetic separation action is achieved on the same principle as above described.

Figure 3:
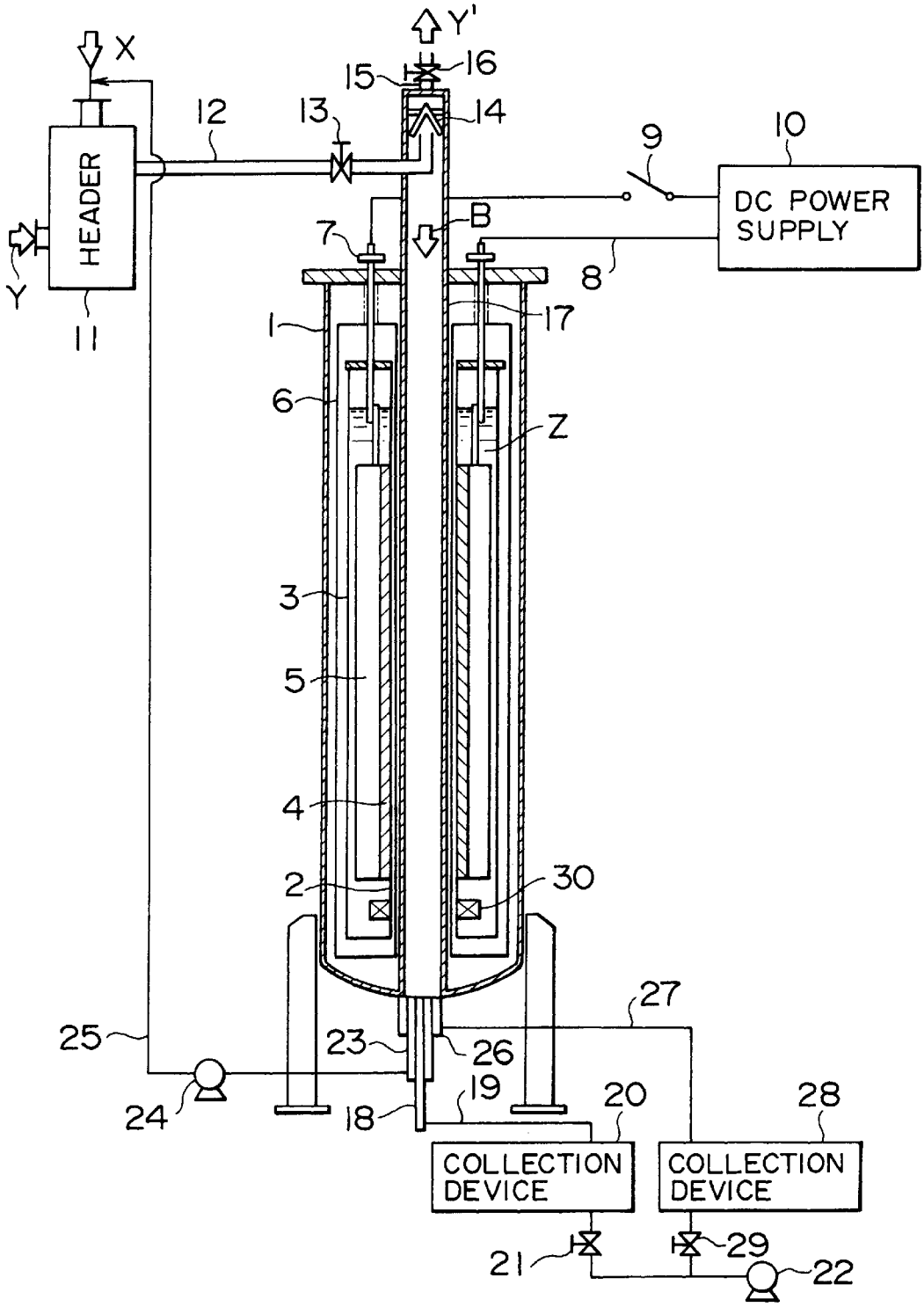
FIG. 3 is a diagram illustrating the configuration of another magnetic separator, which is a second embodiment of the present invention.

FIG. 3 is a side view of the magnetic separator, which is the second embodiment of the present invention. In FIG. 3, reference numerals 1 to 29 are the same as of the first embodiment of FIG. 1. Thus, the redundant description thereof is omitted. Characteristic portion of the second embodiment is a portion to which a persistent currant switch is added.

Figure 4:
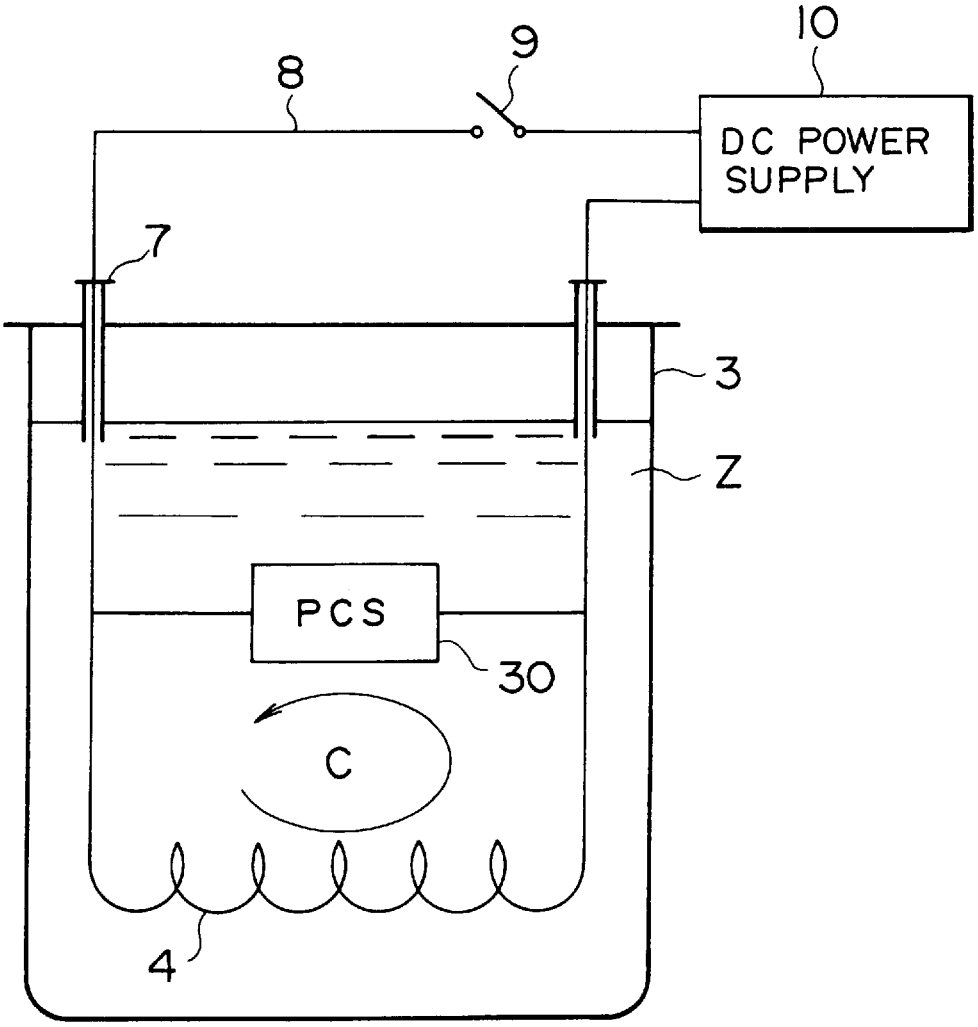
FIG. 4 is a schematic diagram illustrating the electrical wiring system of the second embodiment of the present invention.

FIG. 4 is a schematic diagram illustrating the electrical wiring system of a persistent current switch of the second embodiment of the present invention. During operation of this separator, a DC current is supplied to the quadrupole magnet (superconducting coils) by an current lead 7 through a switch 9 and a bus bar 8 from a DC power supply 10. Moreover, the quadrupole magnets 4 is connected in parallel with a persistent current switch 30. The persistent current switch 30 is cooled. Furthermore, the entire electrical circuit is in a superconducting state as a result of persistent current mode operation, so that the power loss due to Joule's heat is eliminated. Thus, during a closed circuit indicated by letter C, an electric current can be the quadrupole magnet 4 only by supplementing the evaporation of liquid helium, which is caused to heat of penetration almost without supplying power.

Incidentally, the copper line is cooled. When reaching a liquid nitrogen (−196 degrees centigrade) , the resistance of the copper line is reduced by a factor of 5 to 10. Thus, a current passing through the copper line can be increased. Thereby, a high magnetic field can be obtained by the circuit of the same size by using the normal conducting coils which is cooled with liquid crystal.

Figure 5:
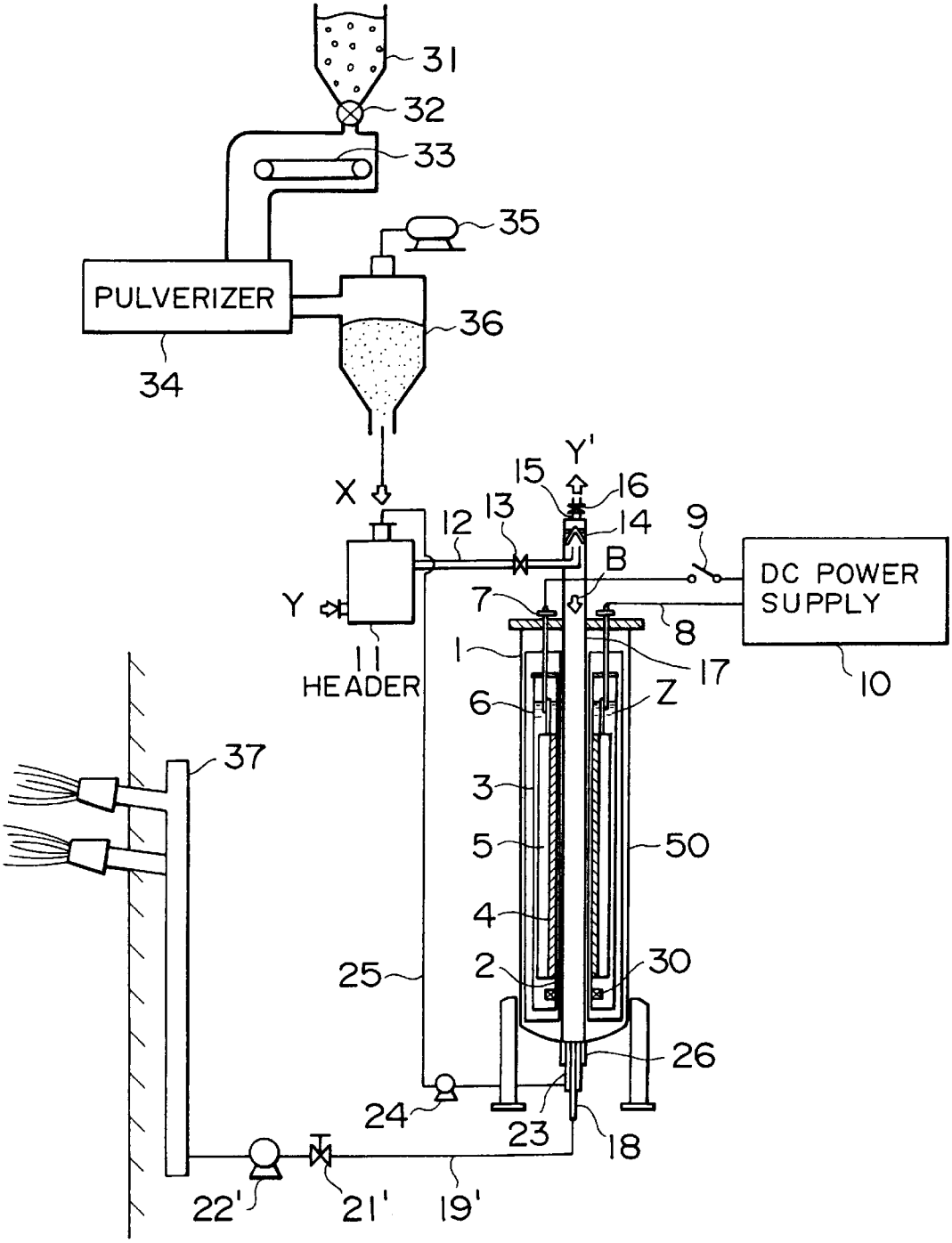
FIG. 5 is a diagram illustrating the configuration of a pulverized coal combustion apparatus which uses a magnetic separator and is a third embodiment of the present invention.

FIG. 5 is a diagram illustrating the configuration of a pulverized coal combustion apparatus which uses a magnetic separator and is the third embodiment of the present invention. In FIG. 5, portions indicated by reference numerals 31, 7, 19', 21' and 22' are characteristic portions of this third embodiment. The rest is a magnetic separator which is the same as of the first and second embodiments of FIGS. 1 and 3. Such a magnetic separator is indicated by a reference numeral 50.

In FIG. 5, reference numeral 50 designates the aforementioned magnetic separator; 31 a coal bunker; 32 a coal gate; 33 a coal feeder; 34 a pulverizer; 35 a blower; 36 a pulverized coal reservoir for supplying pulverized coal to the header 11 of the magnetic separator 50; 37 a coal burner; 19' collection piping; 21' a flow regulating valve; and 22' a blower for supplying collected pulverized coal to the coal burner 37.

In the pulverized coal combustion apparatus having such a configuration, coal is first thrown into the coal bunker 31. Then, coal is led from the coal gate 32 to the coal feeder 33. Subsequently, the coal is supplied to the pulverizer 34 whereupon the coal is pulverized to obtain pulverized coal. The pulverized coal is held in the pulverized coal reservoir 36. Subsequently, the pulverized coal is supplied therefrom to the header 11 of the magnetic separator 50.

The pulverized coal passes through the magnetic separator 50 to thereby separate impurities such as pearlite and kaolinite and ash therefrom. Then, only combustible materials (organic constituents) is led from the collection piping 19' to the coal burner 37 and is burned therein.

In the case of the first embodiment described above (see FIGS. 1 and 2), rotation drive mechanical parts are not present in the working or operating space. Thus, troubles due to the mechanical parts in the operating space, such as the clogging, which is owing to the fine particles, and the abrasion, are not caused. Thus, the problem of the residual magnetization, which has been caused in the mechanical parts of the conventional apparatus, does not occur. Moreover, heat emission and rotation loss due to eddy current, which has been generated in the rotating portions of the mechanical parts in the conventional case, are not caused. Furthermore, the pulverized coal collides with the baffle plate 14 and is diffused. Thus, the fine particles are uniformly scattered. Additionally, the particles fall under their weight, so that the accuracy of the magnetic separation is enhanced.

In the case of the second embodiment (see FIGS. 3 and 4), advantages and effects, which are similar to those of the aforementioned first embodiment, are obtained. Moreover, the persistent current mode operation is performed, so that the entire electrical circuit is in a superconducting state as a result of persistent current mode operation, and thus the power loss due to Joule's heat is reduced. Further, the copper line is cooled. When reaching a liquid nitrogen (−196 degrees centigrade) , the resistance of the copper line is reduced by a factor of 5 to 10. Thus, a current passing through the copper line can be increased. Thereby, a high magnetic field can be obtained by the circuit of the same size.

Furthermore, in the case of the third embodiment (see FIG. 5), the labor and space for the storage, retention and conveyance of combustible (organic) materials obtained by the magnetic separator 50 for coal cleaning become unnecessary. Consequently, a compact, high-quality high-efficiency coal combustion system is obtained.

Incidentally, the embodiments of the present invention have been described in connection with the pulverized coal by way of example. The present invention is, however, not limited thereto. For example, the present invention can be applied to the recycling of various kinds of resources and to a waste treatment. Thereby, similar effects and advantages are obtained.

Further, in the case of the second and third embodiments of the present invention, a plurality of the homopole opposing solenoid magnets 60 as illustrated in FIGS. 6 and 7 may be substituted for the quadrupole magnets 4 incorporated into the aforementioned magnetic separator. In this case, the plurality of solenoid magnets 60 excited in such a way as to have homopole and be opposed are arranged concentrically and in the axial direction. In the case of using the homopole opposing solenoid magnets 60, the distribution of lines of magnetic force and the magnetic field distribution as illustrated in FIG. 8 are exhibited. However, the magnetic separation can be achieved on the same principle as above described.

As above described concretely, the present invention basically provides a magnetic separator which comprises an inner duct, quadrupole magnets disposed around the inner duct, fine-particle supply means provided on the top end portion of the inner duct, first and second collection tubes that are provided at the bottom portion of the inner duct and are used for collecting paramagnetic materials and non-magnetic materials, respectively. Moreover, the present invention further provides a magnetic separator having an umbrella-like baffle plate provided in the fine-particle supply means; a magnetic separator having quadrupole magnets respectively constituted by normal conducting coils; a magnetic separator having a persistent current switch in parallel with the quadrupole magnets; and a magnetic separator having a collection tube for collecting intermediate materials, in addition to the first and second collection tubes. Additionally, the present invention provides a pulverized coal combustion apparatus using the magnetic separator. Thus, the present invention has the following advantages.

(1) No mechanical parts are provided in the duct. Thus, troubles due to the mechanical parts in the operating space, such as the clogging, which is owing to the fine particles, and the abrasion, are not caused. Moreover, heat emission and rotation loss due to eddy current are not caused.

(2) The separator is provided with an umbrella-like baffle plate. Thereby, pulverized coal is ejected upwardly from the lower portion. Thus, after the pulverized coal collides with the baffle plate, the pulverized coal is diffused. Thus, the fine particles are uniformly scattered. Additionally, the particles fall under their weight, so that the accuracy of the magnetic separation is enhanced.

(3) In the case that normal conducting coils are cooled by liquid nitrogen and are used as the quadrupole magnets, a large current can be made by a compact apparatus to flow. Moreover, a high magnetic field are obtained. Furthermore, the cost of refrigerant can be reduced.

(4) In the case that the quadrupole magnets are constituted by combining superconducting coils with a persistent current switch, a persistent current mode is used. Thus, during operation, it is unnecessary to supply power thereto. The evaporation of liquid helium due to heat of penetration has only to be supplemented.

(5) In the case of a pulverized coal combustion apparatus using a magnetic separator, combustible (organic) materials are used directly for combustion in a boiler. Thus, the storage space for combustible materials is unnecessary. Time and effort on the control of quality, which is associated with the storage of the combustible materials, are saved. Moreover, the conveyance thereof to the coal feeder, the space for the coal feeder become unnecessary. Consequently, a compact high-quality high-efficiency coal combustion system are obtained.

Although the preferred embodiments of the present invention have been described above, it should be understood that the present invention is not limited thereto and that other modifications will be apparent to those skilled in the art without departing from the spirit of the invention.

The scope of the present invention, therefore, should be determined solely by the appended claims.

What is claimed is:

1. A magnetic separator comprising:

(a) a cylindrical inner duct disposed along a vertical direction;

(b) quadrupole magnets placed around said inner duct, wherein said quadrupole magnets are cooled by a cryogen and excited by use of a DC power supply;

(c) fine-particle supply for ejecting and dropping fine particles, which consist of a plurality of elements and compounds, from a top end of said inner duct, said fine-particle supply comprising an umbrella-like baffle plate disposed in said top end portion, wherein fine particles are ejected upwardly toward said baffle plate from a lower portion thereof, and then the fine particles having collided with said baffle plate are caused to drop toward said inner duct; and (d) first and second collection tubes, which are provided at a bottom portion of said inner duct, for separating and collecting a paramagnetic material and a non-magnetic material, which are included in the fine particles, owing to a difference between magnetic forces respectively acted on the fine particles, which are ejected from the fine-particle supply and drop.

2. A magnetic separator according to claim 1, wherein said quadrupole magnets comprise superconducting coils and said cryogen comprises liquid helium.

3. A magnetic separator according to claim 1, wherein said quadrupole magnets comprise normal conducting coils and said cryogen comprises liquid nitrogen.

4. A magnetic separator according to claim 1, wherein a plurality of homopole opposing solenoid magnets are provided instead of said quadrupole magnets.

5. A magnetic separator according to claim 1, 2, 3 or 4, wherein a persistent current circuit switch is connected in parallel with said quadrupole magnets or with said plurality of homopole opposing solenoid magnets.

6. The magnetic separator according to claim 1, 2, 3 or 4, wherein an intermediate-material collection tube, which is operative to collect intermediate materials, and a bypass collection tube, which is operative to supply the material collected by said intermediate-material collection tube, are provided between said first and second collection tubes.

7. A magnetic separator comprising:

(a) a cylindrical inner duct disposed along a vertical direction;

(b) quadrupole magnets placed around said inner duct, wherein said quadrupole magnets are cooled by a cryogen and excited by use of a DC power supply;

(c) fine-particle supply for ejecting and dropping fine particles, which consist of a plurality of elements and compounds, from a top end of said inner duct;

(d) first and second collection tubes, which are provided at a bottom portion of said inner duct, for separating and collecting a paramagnetic material and a non-magnetic material, which are included in the fine particles, owing to a difference between magnetic forces respectively acted on the fine particles, which are ejected from the fine particle supply means and drop; and (e) a persistent current circuit switch connected in parallel with said quadrupole magnets.

* * * * *